US007090102B1

(12) United States Patent
Lipke

(10) Patent No.: US 7,090,102 B1
(45) Date of Patent: Aug. 15, 2006

(54) SYSTEMS AND METHODS FOR HOLDING PORTABLE ELECTRONIC DEVICES

(75) Inventor: Richard A. Lipke, Bellingham, WA (US)

(73) Assignee: Conterra, Inc., Bellingham, WA (US)

( * ) Notice: Subject to any disclaimer, the term of this patent is extended or adjusted under 35 U.S.C. 154(b) by 70 days.

(21) Appl. No.: 10/367,087

(22) Filed: Feb. 14, 2003

Related U.S. Application Data

(60) Provisional application No. 60/357,420, filed on Feb. 14, 2002.

(51) Int. Cl.
*A41D 1/04* (2006.01)
*A41D 27/20* (2006.01)
*A45F 4/00* (2006.01)

(52) U.S. Cl. ..... 224/250; 224/575; 2/247

(58) Field of Classification Search ..... 224/240, 224/250, 647, 649, 582, 583, 683; 190/108, 190/110; 2/247, 249
See application file for complete search history.

(56) References Cited

U.S. PATENT DOCUMENTS 827,010 A * 7/1906 Greenwald ..... 2/249
4,106,121 A * 8/1978 Belson ..... 2/102
4,139,914 A * 2/1979 Tarr ..... 2/247
4,350,194 A * 9/1982 Brown ..... 206/315.5
4,651,355 A * 3/1987 White ..... 2/247
4,744,398 A 5/1988 Clark
4,969,214 A * 11/1990 Cohen ..... 2/94
4,986,459 A * 1/1991 Yarbrough, Jr. ..... 224/661
5,054,127 A * 10/1991 Zevchak ..... 2/247
5,230,452 A * 7/1993 Wagner ..... 224/240
5,465,425 A * 11/1995 Crispin ..... 2/102
5,501,379 A * 3/1996 Munoz ..... 224/240
5,505,356 A * 4/1996 Noriega et al. ..... 224/250
5,526,924 A 6/1996 Klutznick
5,567,055 A * 10/1996 Smith ..... 383/38
5,604,958 A * 2/1997 Anscher ..... 24/3.1
5,628,443 A * 5/1997 Deutsch ..... 224/583
5,644,785 A 7/1997 Garrett
5,653,336 A 8/1997 Buonaiuto et al.
5,653,367 A 8/1997 Abramson
5,693,006 A * 12/1997 Slautterback ..... 602/19
5,711,469 A 1/1998 Gormley et al.
5,743,447 A * 4/1998 McDermott ..... 224/153
5,815,843 A * 10/1998 Brillhart et al. ..... 2/247
5,833,095 A * 11/1998 Russell et al. ..... 224/576
5,957,357 A 9/1999 Kallman
5,991,925 A * 11/1999 Wu ..... 2/102

(Continued)

OTHER PUBLICATIONS

Drawing, "Conterra" prior art (Exhibit A).

(Continued)

*Primary Examiner*—Sue A. Weaver
(74) *Attorney, Agent, or Firm*—Michael R. Schact; Schacht Law Office Inc.

(57) ABSTRACT

A system for holding an electronic device comprising a first substrate, a pocket assembly, and a fastener system comprising first, second, third, fourth, and fifth fasteners. The first substrate is adapted to be supported by a wearer. The pocket assembly is adapted to hold the electronic device. The first and second fasteners are rigidly connected to the pocket assembly, while the third, fourth, and fifth fasteners are rigidly connected to the substrate. In a first mode, the first fastener engages the third fastener and the second fastener engages the fourth fastener to attach the pocket assembly to the first substrate. In a second mode, the first fastener engages the third fastener and the second fastener engages the fifth fastener to attach the pocket assembly to the first substrate.

20 Claims, 5 Drawing Sheets

U.S. PATENT DOCUMENTS

| | | | | |
|---|---|---|---|---|
| 6,152,338 | A * | 11/2000 | Smith | 224/149 |
| 6,182,878 | B1 | 2/2001 | Racca | |
| 6,185,738 | B1 * | 2/2001 | Sidebottom | 2/2.5 |
| 6,189,750 | B1 * | 2/2001 | Von Neumann | 224/153 |
| 6,209,769 | B1 * | 4/2001 | Seals et al. | 224/583 |
| 6,216,931 | B1 * | 4/2001 | Trawinski | 224/583 |
| 6,216,932 | B1 | 4/2001 | Wu | |
| 6,390,346 | B1 * | 5/2002 | Thomas | 224/605 |
| 6,412,674 | B1 | 7/2002 | Lipke | |
| 6,568,575 | B1 * | 5/2003 | Bartholomew | 224/583 |
| 6,662,373 | B1 * | 12/2003 | Frank | 2/94 |
| 6,726,075 | B1 * | 4/2004 | Patel et al. | 224/582 |

OTHER PUBLICATIONS

Drawing, “Cascade Tobaggan” prior art (Exhibit B).
Drawing, “Motorola & others” pior art (Exhibit C).

* cited by examiner

SYSTEMS AND METHODS FOR HOLDING PORTABLE ELECTRONIC DEVICES

RELATED APPLICATIONS

This application claims priority of U.S. Provisional Patent Application Ser. No. 60/357,420, which was filed on Feb. 14, 2002.

TECHNICAL FIELD

The present invention relates to systems and methods for carrying electronic devices and, more specifically, to systems and methods that allow small items such as two-way radios to be carried during strenuous physical activities.

BACKGROUND OF THE INVENTION

People performing strenuous physical activities often carry small devices such as electronic devices, water bottles, and the like. These devices often allow or require human interaction during normal operation. Desirably, these devices can be used while performing the strenuous physical activity without the need for using hands. For example, a person may drink from the water bottle while performing a biking. As another example, a person may wish to listen and/or talk to portable electronic devices such as a radio transceiver.

The present invention is of particular significance in the context of a two-way radio transceiver and will be described below in that context. However, one of ordinary skill in the art will recognize that the present invention may also be used with other portable devices such as water bottles, food canisters, cellular telephones, portable radio receivers, portable audio devices, and the like.

Radio transceivers that allow two-way communications have long been used by police, firefighters, ski patrol, and others. In addition, a new class of two-way radio transceivers has recently gained broad acceptance by the general public for recreational use. Modern radio transceivers are small and light-weight enough to be carried and even used during physical activities such as walking, biking, and skiing.

The present invention relates to holders for small devices such as radios that allow these devices to be used during strenuous physical activities. The present invention is particularly suited for use during physical activities, such as mountain biking or skiing, in which the device may interfere with the activity or that require use of the hands.

SUMMARY OF THE INVENTION

The present invention may be embodied as a system for holding a device comprising a first substrate, a pocket assembly, and a fastener system comprising first, second, third, fourth, and fifth fasteners. The first substrate is adapted to be supported by a wearer. The pocket assembly is adapted to hold the device. The first and second fasteners are rigidly connected to the pocket assembly, while the third, fourth, and fifth fasteners are rigidly connected to the substrate. In a first mode, the first fastener engages the third fastener and the second fastener engages the fourth fastener to attach the pocket assembly to the first substrate. In a second mode, the first fastener engages the third fastener and the second fastener engages the fifth fastener to attach the pocket assembly to the first substrate. The present invention may further be embodied as a method of holding a device during a strenuous physical activity.

DETAILED DESCRIPTION OF THE INVENTION

Figure 2:
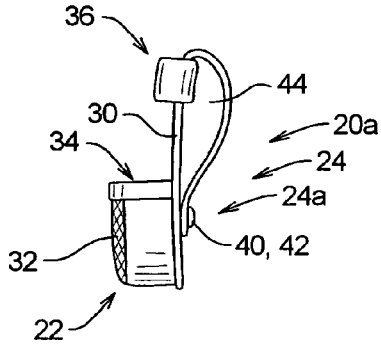
FIG. 2 is a side elevation view of the radio pocket assembly of FIG. 1 in a first configuration.
Figure 3:
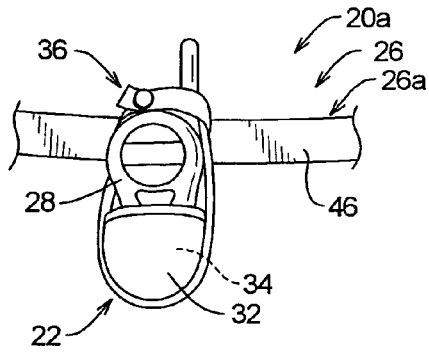
FIG. 3 is a front elevation view of the radio pocket assembly of FIG. 1 in the first configuration shown in FIG. 2 being used in a first mode in which it is attached to a belt.
Figure 5:
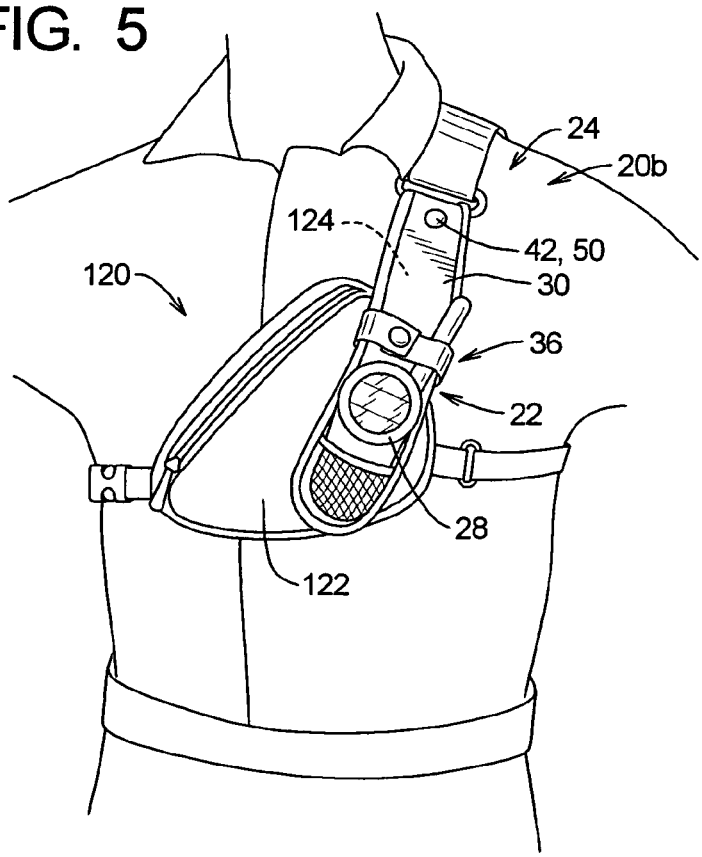
FIG. 5 is a front elevation view of the radio pocket assembly of FIG. 1 in a second configuration being used in a second mode in which it is attached to a chest harness.
Figure 6:
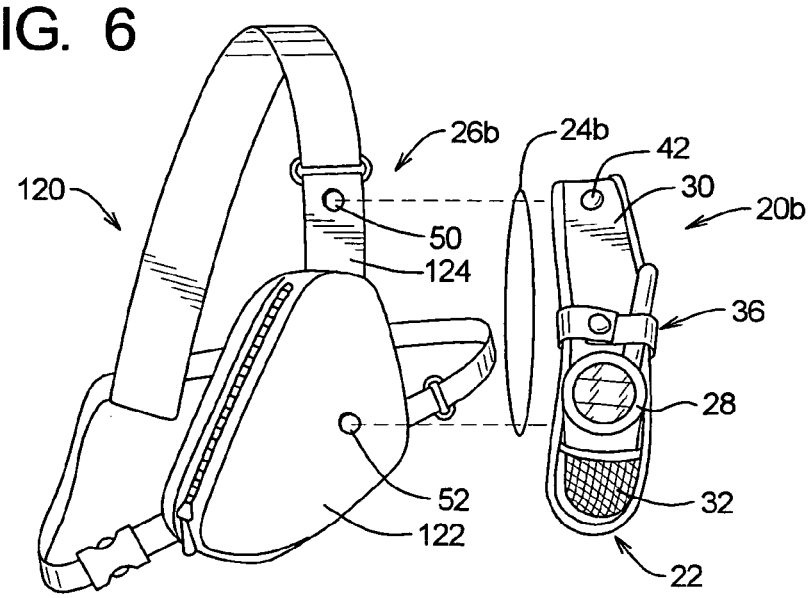
FIG. 6 is an exploded view depicting the formation of the radio pocket system of FIG. 5.

Depicted at 20 in the drawing is a radio pocket system constructed in accordance with, and embodying, the principals of the present invention. The radio pocket system 20 may exist or be used in several different modes of operation. In particular, the radio pocket system 20 may be used in a first mode 20*a* as shown in FIGS. 2 and 3, and a second mode 20*b* is shown in FIGS. 5 and 6, and/or in a third mode as shown in FIGS. 7*b*, 8*b*, and 10*b*.

The radio pocket system 20 comprises a radio pocket assembly 22, a fastener system 24, and a substrate 26. The radio pocket assembly 22 is adapted to hold a radio 28. The fastener system 24 is adapted to secure the radio pocket assembly 22 to the substrate 26.

The substrate 26 can take one or more of many different forms. Four different exemplary forms of the substrate will be described herein. The fastener system 24 may also take different forms depending on the substrate 26. In addition, the radio pocket assembly 22 exists in one of two different configurations depending on the particular substrate 26 and form of the fastener system 24.

Referring now to FIGS. 1–4, it can be seen that the radio pocket assembly 22 comprises a pocket rear panel 30 and a pocket front panel 32. These panels 30 and 32 are connected together to form a radio cavity 34 in which the radio 28 is supported. The exemplary radio pocket assembly 22 further comprises a retainer strap system 36 as will be described in further detail below. The details of construction of the pocket rear and front panels 30 and 32 and the retainer strap system 36 are not important to the present invention. The radio pocket assembly 22 will thus be described herein only to the extent necessary for complete understanding of the present invention.

Figure 1:
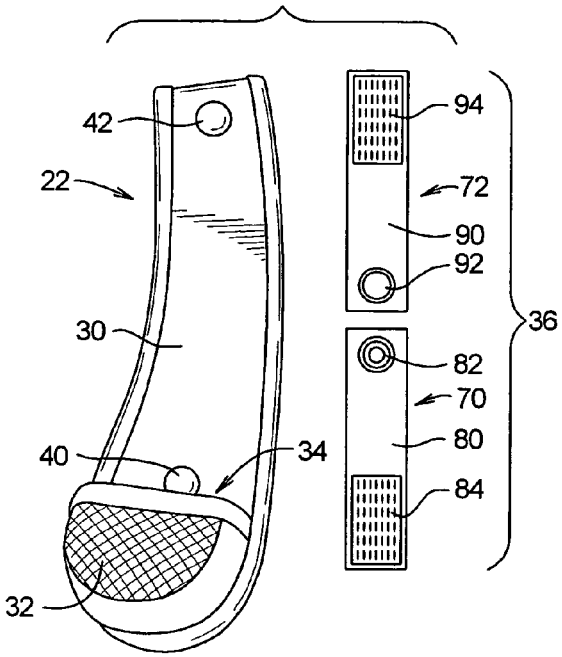
FIG. 1 is an exploded view of a radio pocket assembly of the present invention.
Figure 4:
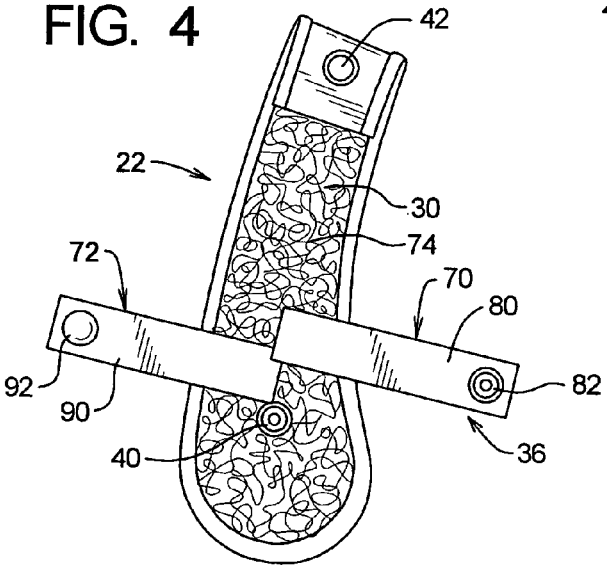
FIG. 4 is a rear elevation view of the radio pocket assembly of FIG. 1.

As perhaps best shown in FIGS. 1, 2, and 4, a male fastener 40 (first fastener) and a female fastener 42 (second fastener) are secured to the pocket rear panel 30. The example fasteners 40 and 42 are snap fasteners conventionally available on the market place. These snap fasteners are riveted into holes formed in the rear panel 30 in a conventional manner to prevent relative movement between the panel 30 and the fasteners 40 and 42 under normal conditions.

Fasteners other than snap fasteners may be used to form the male and female fasteners 40 and 42. For example, a hook and loop type fastener may be used under some circumstances. In this case, the hook portion may take the place of one of the male or female fasteners 40 and 42, and the loop portion will take the place of the other of the fasteners 40 and 42. In another situation, buttons and buttonholes may be substituted for these example snap fasteners 40 and 42. The fasteners 40 and 42 may also be replaced by buckles and other means of fastening straps or fabric together.

It is also not essential that the male and female snap fasteners 40 and 42 be located on the panel 30 exactly as shown in FIG. 1. For example, one of ordinary skill in the art will recognize that the positions of these fasteners 40 and 42 may be reversed. The relative position and location of fasteners used in connection with the substrates 26 described in further detail below should correspond to the relative positions and locations of the fasteners 40 and 42.

The three modes in which the system 20 may be used will now be discussed in further detail.

As shown in FIG. 2 the male and female snap fasteners 40 and 42 allow the radio pocket assembly 22 to be placed into a first configuration in which it defines a belt opening 44. In this configuration, the radio pocket system 20 is in its first mode 20*a* and can be used to suspend the radio 28 from a belt 46 defining a first substrate 26*a*.

Referring now to FIG. 6, depicted therein is a second example substrate 26*b* on which are formed a male fastener 50 (third fastener) and a female fastener 52 (fourth fastener). With this second exemplary substrate 26*b*, the radio pocket system 20 may be embodied in a second mode 20*b* in which the male fastener 40 is connected to the female fastener 52 and the female fastener 42 is connected to the male fastener 50 to define a fastener system 24*b*. When the system 20 is in this second mode 20*b*, the pocket rear panel 30 is in a generally flat configuration. The locations of the male and female fasteners 50 and 52 on the second substrate 26*b* are not critical, but the distance between the fasteners 50 and 52 is generally the same as the distance between the first male and female fasteners 40 and 42 when the pocket rear panel 30 is flat.

Figure 7A:
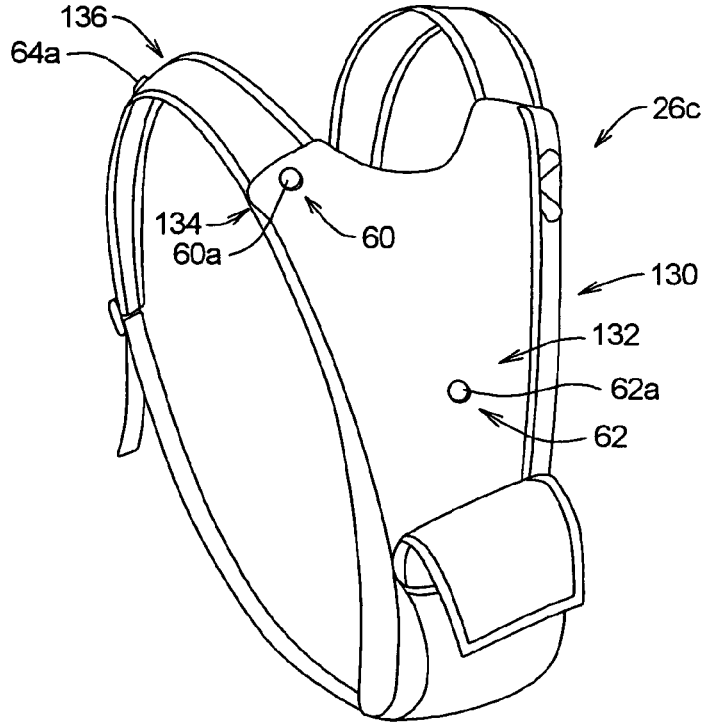
FIGS. 7*a* and 8*a* are perspective views of a backpack that may be used as part of the radio pocket system with the present invention in a third mode.
Figure 7B:
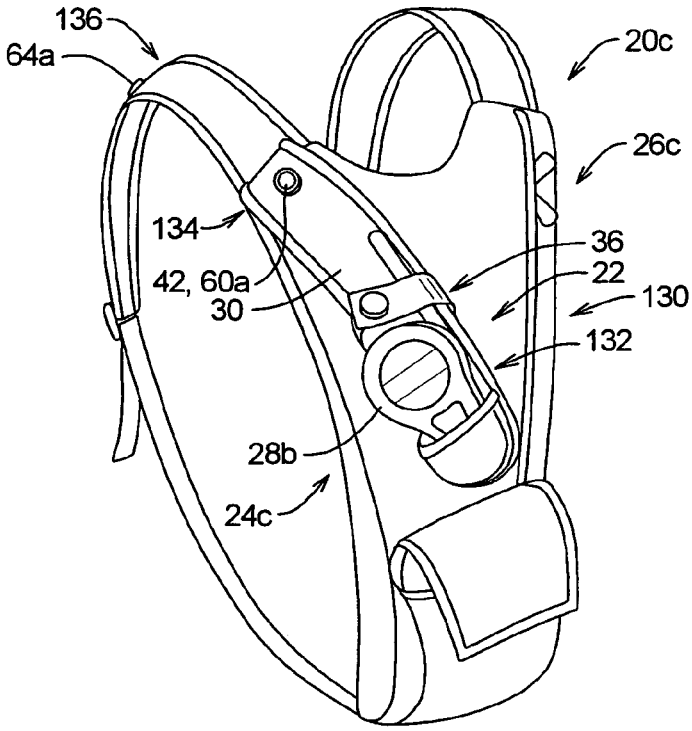
FIGS. 7*b* and 8*b* are perspective views of the radio pocket system of the present invention in its third mode.
Figure 8A:
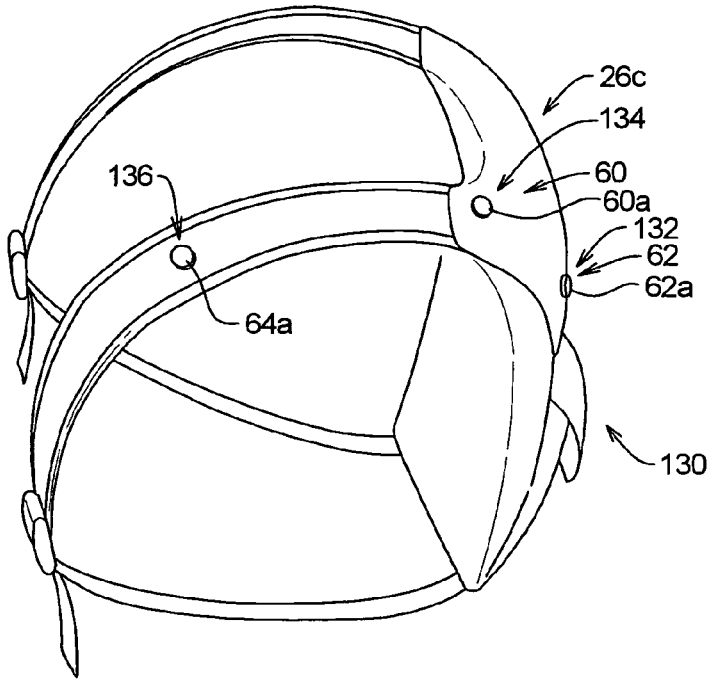
Figure 8B:
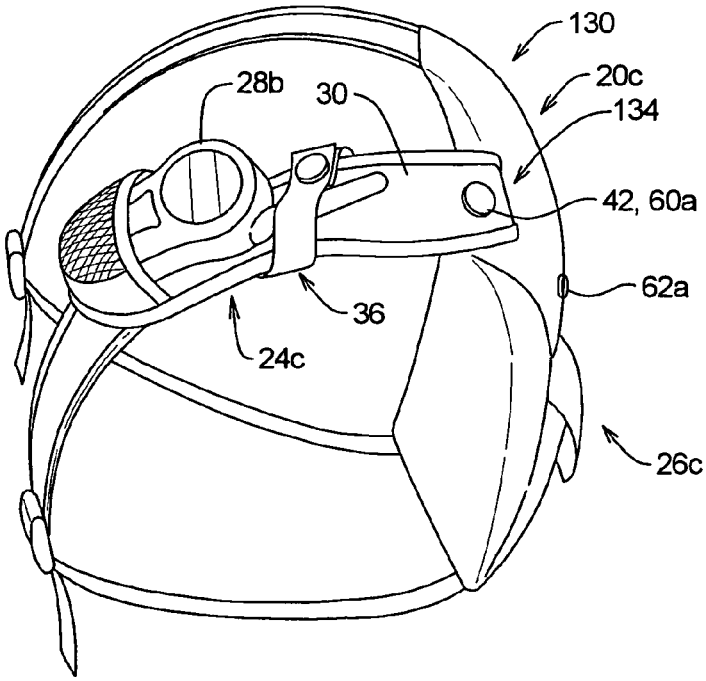

Referring now to FIGS. 7*a* and 8*a*, depicted therein is yet another exemplary substrate 26*c* to which the radio pocket system 20 may secure the radio 28. Secured to the third example substrate 26*c* are a male fastener 60*a* (third fastener), a front female fastener 62*a* (fourth fastener), and a rear female fastener 64*a* (fifth fastener). The exact locations of these fasteners 60*a*, 62*a*, and 64*a* are somewhat arbitrary. However, the distance between the male fastener 60*a* and the female fasteners 62*a* and 64*a* should be approximately the same as the distance between the fasteners 40 and 42 when the pocket rear panel 30 is flat.

As shown in FIGS. 7*b* and 8*b*, the radio pocket system 20 may exist in a third mode 20*c* in which it secures the radio 28 to the third substrate 26*c*. In addition, the radio pocket system 20 allows the radio 28 to be located in one of first and second secured positions as can be seen by comparison in FIGS. 7*b* and 8*b*.

More specifically, when the radio pocket system 20 is in the third mode 20*c* and the radio 28 is in its first position (FIG. 7B), a fastening system 24*c* is formed by the engagement of the male fastener 40 (first fastener) with the front female fastener 62*a* (fourth fastener) and of the female fastener 42 with the male fastener 60*a* (third fastener). When the system 20 is in the third mode 20*c* and the radio 28 is in its second position (FIG. 8B), the fastener system 24*c* is formed by the engagement of the male fastener 40 (first fastener) with the rear female fastener 64*a* (fifth fastener) and of the female fastener 42 (second fastener) with the male fastener 60*a* (fourth fastener).

Figure 9A:
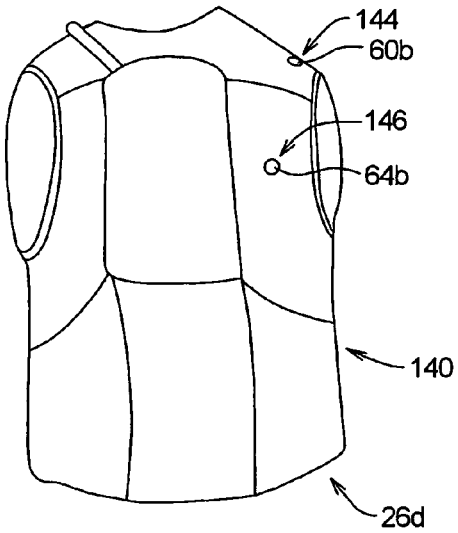
FIGS. 9*a* and 10*a* are front and rear views of a vest that may form a portion of the radio pocket system of the present invention.
Figure 10A:
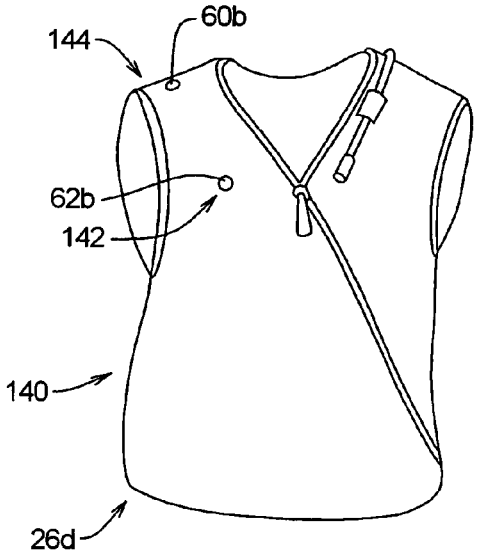
Figure 10B:
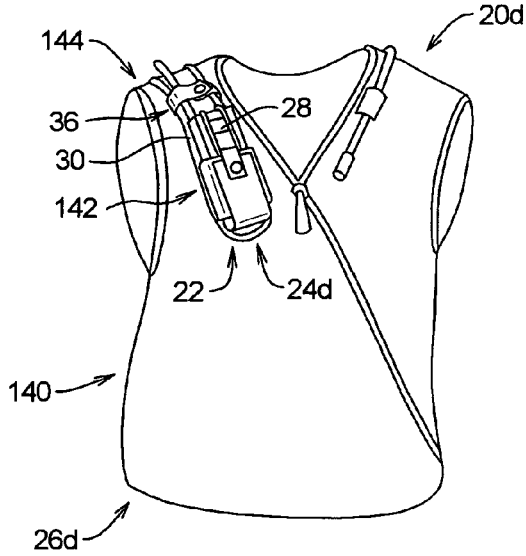

Referring now to FIGS. 9*a* and 10*a*, depicted therein is yet another example substrate 26*d* that may form a part of the radio system 20. A male fastener 60*b* (third fastener), front female fastener 62*b* (fourth fastener), and rear female fastener 64*b* (fifth fastener) are secured to the example substrate 26*d*. Again, the locations of these fasteners 60*b*, 62*b*, and 64*b* are somewhat arbitrary but should correspond fairly closely to the spacing of the first male and female fasteners 40 and 42 from each other on the pocket rear panel 30 when this panel 30 is laid flat.

Figure 9B:
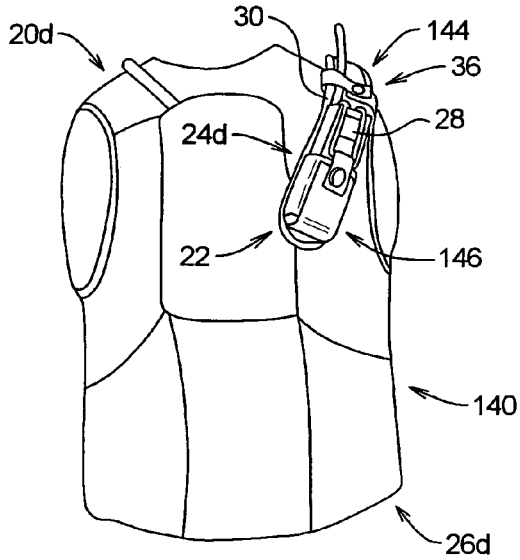
FIGS. 9*b* and 10*b* are views similar to 9*a* and 10*a* depicting the entire radio pocket system in its third mode.

With the exemplary substrate 26*d*, the radio pocket system 20 may exist in yet another mode 20*d* similar to the third mode 20*c* described above. In particular, the radio 28 can be attached to the substrate 26*d* in one of two positions. In a first position as shown in FIG. 10*b*, the male fastener 40 (first fastener) engages the front female fastener 62*b* (fourth fastener) and the female fastener 42 engages the male fastener 60*b* (third fastener) to form a fastener system 24*d*. When the radio 28 is in its second position as shown in FIG. 9*b*, the fastener system 24*d* is formed by the engagement of the male fastener 40 (first fastener) with the rear female fastener 64*b* (fifth fastener) and the female fastener 42 (second fastener) with the male fastener 60*b* (third fastener).

The radio pocket system 20 described herein thus provides significant flexibility to the user as to how and where the pocket assembly 22 is attached to different types of substrates 26. Further, with some of these substrates, it is desirable to locate the radio 28 in different positions depending on how the substrate 26 itself is being used. The radio pocket system 20 of the present invention allows the radio to be located in these different positions as well.

With the foregoing basic understanding of the present invention, the exemplary radio pocket system 20 and exemplary substrates 26 to which the system 20 attaches the radio 28 will now be described in further detail.

Referring initially to FIGS. 1 and 4, the exemplary retainer strap system 36 will now be described in further detail. As shown in FIGS. 1 and 4, the retainer strap system 36 comprises a first strap assembly 70, a second strap assembly 72, and a loop panel 74. The loop panel 74 is secured to the side of a pocket rear panel 30 opposite the pocket front panel 32 and radio cavity 34.

The first strap assembly 70 comprises a first strap member 80, a first strap male fastener 82, and a first hook panel 84. The second strap assembly 72 comprises a second strap member 90, a strap female fastener 92, and a second hook panel 94. The fasteners 82, 92 and hook panels 84, 94 are secured to opposite ends of the strap members 80, 90, respectively.

As shown in FIG. 4, the hook panels 84 and 94 are adapted to engage the loop panel 74 to form a hook/loop fastener system 76 that inhibits movement of the strap members 80 and 90 relative to the pocket rear panel 30. As shown in FIGS. 2 and 3, the strap members 80 and 90 extend around the pocket rear panel 30 such that the strap fasteners 80 and 92 can be joined together just above the radio cavity 34. Accordingly, as shown in FIG. 3, the exemplary retainer strap 36 may engage an upper portion of the radio 28 to secure the radio 28 with at least partly within the radio cavity 34.

The retainer strap system 36 is not necessary to practice the present invention in its broadest form. The retainer strap system 36 may thus be omitted, or other similar systems may be used in conjunction with and/or instead of the exemplary system 36.

Referring now for a moment back to FIG. 6, it can be seen that the exemplary substrate 26*b* shown therein is formed on a chest harness 120. The chest harness 120 defines a front portion 122 and shoulder portion 124. The male fastener 50 and second female fastener 52 are located at the chest harness shoulder portion 124 and chest harness front portion 122, respectively. Accordingly, when the chest harness 120 is properly worn and the radio pocket assembly 22 is attached thereto using the fastener system 24*b*, the radio 28 is located conveniently on the chest of a person wearing the chest harness 120 as shown in FIG. 5. This location of the radio 28 allows the wearer of the chest harness 120 to perform an activity such as skiing or bicycling and still use the radio 28 with minimal or no use of hands.

Referring now to FIGS. 7*a* and 8*a*, it can be seen that the exemplary substrate 26*c* disclosed therein is a backpack 130. The backpack 130 comprises a front portion 132, a shoulder portion 134, and a rear portion 136. The third male fastener 60*a* is located at the shoulder portion 134, the front female fastener 62*a* at the backpack front portion 132, and rear female fastener 64*a* is located at the backpack rear portion 136.

As shown in FIGS. 7*b* and 8*b*, the backpack front portion 132 will typically be a strap that extends across the chest of the wearer of the backpack 130. Accordingly, when the radio 28 is in the first position as shown in FIG. 8*b*, the radio 28 is conveniently located for use by the wearer of the backpack 130.

However, in some situations the wearer may desire to have the radio 28*b* arranged away from the wearer's chest region. For example, the user may wish the radio to be in the second position is when the user is mountain biking and does not want any unnecessary equipment arranged in the chest area. In this case, the wearer may simply detach the male fastener 40 (first fastener) from the female fastener 62*a* (fourth fastener), swing the radio pocket assembly 22 from the first position into the second position without disconnecting the fasteners 42 and 60*a* (second and third fasteners) from each other, and then connect the male fastener 40 (first fastener) to the rear female fastener 64*a* (fifth fastener) to secure the radio 28 in its second position.

Referring now to FIGS. 9*a* and 10*a*, it can be seen that the fourth exemplary substrate 26*d* may be formed by a vest 140. The vest 140 defines a front portion 142, a shoulder portion 144, and a rear portion 146. The exemplary vest 140 is adapted to contain a hydration system that allows the user to carry a supply of water on the back and drink the water from a tube arranged in the wearer's chest area. Other types of vests 140 may be used with the principals of the present invention, however.

The system 20 may be placed in a third mode 20*d* in which the user locates the radio 28 either in front adjacent to the user's chest area or in back in a location adjacent to the user's shoulder blade.

In the first position, with the radio 28 located in front, the male fastener 40 (first fastener) is connected to the front female fastener 62*b* (fourth fastener) and the female fastener 42 (second fastener) is connected to the male fastener 60*b* (third fastener) located on the shoulder portion 144 of the vest 140. The radio 28 may be moved into its second position by detaching the male fastener 40 (first fastener) from the front female fastener 62*b* (fourth fastener), rotating the radio pocket assembly 22 from the first to the second position with the female fastener 42 (second fastener) engaging the male fastener 60*b* (fourth fastener), and then attaching the male fastener 40 (first fastener) to the rear female fastener 64*b* (fifth fastener).

From the foregoing, it should be clear that the radio pocket system 20 of the present invention provides the designer of the substrate 26 and the user of the radio 28 with significant flexibility in how the radio 28 may be positioned. In the first mode, the radio may be hung from any type of belt, belt loop, strap, or the like in a manner that is generally conventional. In the second mode, the radio pocket system 20 may be used with an article like the chest harness 120 that defines two fixed locations where the male fastener 50 and second female fastener 52 may be located. The exemplary chest harness 120 does not, however, define a third location that is conveniently fixed relative to the locations of the male and female fasteners 50 and 52, and thus does not allow the radio pocket assembly 22 to be moved into two different positions.

The backpack 130 and vest 140 described herein are examples of substrates 26 that define three fixed locations where the third male fastener 60 and front and rear female fasteners 62 and 64 may be located. Accordingly, the substrates 26 defined by the backpack 130 and vest 140 allow the radio pocket assembly 22 to be placed into either of two positions.

One of ordinary skill in the art will recognize that the exact details of construction of the substrates 26 are not important to the principals of the present invention. While the exemplary substrates 26*a–d* described herein are articles of clothing, the principles of the present invention may be applied to other types of substrates as well. For example, the substrate 26 may be formed by a surface on a toolbox, golf bag, automobile interior, or the like where a radio 28 is conveniently and temporarily stored. In addition, while the present invention was shown in first and second modes that allowed the radio to be in only one position and a third mode that allowed the radio 28 to be in two positions, additional fasteners as appropriate may be located to allow even more positions of the radio 28 relative to a given substrate 26.

Given the foregoing, it should be clear that the principals of the present invention may be applied to other environments, and the scope of the present invention should not be limited to the exemplary pocket assembly 22, substrates 26, radio 28 and retainer strap system 36 described herein.

I claim:

1. A system for holding an electronic device comprising:

a first substrate adapted to be supported by a wearer;

a second substrate adapted to be supported by a wearer;

a pocket assembly adapted to hold the electronic device;

a fastener system comprising first and second fasteners rigidly connected to the pocket assembly, and third, fourth, and fifth fasteners rigidly connected to the first substrate; whereby the first fastener engages the third fastener and the second fastener engages the fourth fastener to attach the pocket assembly to the first substrate in a first position;

the first fastener engages the third fastener and the second fastener engages the fifth fastener to attach the pocket assembly to the first substrate in a second position; and the first fastener engages the second fastener to place the pocket assembly in a loop configuration in which the pocket assembly extends around at least a portion of the second substrate to secure the pocket assembly to the second substrate.

2. A system as recited in claim 1, in which the pocket assembly comprises a flexible rear panel, where the rear panel is folded such that the first fastener can engage the second fastener when the pocket assembly is placed in the loop configuration.

3. A system as recited in claim 1, in which the first substrate is adapted to be supported by an upper torso of the wearer such that the third fastener is adjacent to the wearer's shoulder, the fourth fastener is adjacent to the wearer's chest, and the fifth fastener is adjacent to the wearer's back.

4. A system as recited in claim 3, in which the second substrate is a belt.

5. A system as recited in claim 1, in which the second substrate is a belt.

6. A system for holding an electronic device comprising:

a first substrate adapted to be supported by a wearer;

a pocket assembly adapted to hold the electronic device; and a fastener system comprising first and second fasteners rigidly connected to the pocket assembly, and third, fourth, and fifth fasteners rigidly connected to the first substrate; whereby the first fastener engages the third fastener and the second fastener engages the fourth fastener to attach the pocket assembly to the first substrate in a first position;

the first fastener engages the third fastener and the second fastener engages the fifth fastener to attach the pocket assembly to the first substrate in a second position; and the third, fourth, and fifth fasteners are spaced from each other such that the electronic device is supported substantially in front of the wearer when the pocket assembly is in the first position; and the electronic device is supported substantially behind of the wearer when the pocket assembly is in the second position.

7. A system as recited in claim 6, further comprising a second substrate, in which the first fastener engages the second fastener to place the pocket assembly in a loop configuration in which the pocket assembly extends around at least a portion of the second substrate to secure the pocket assembly to the second substrate.

8. A system as recited in claim 7, in which the pocket assembly comprises a flexible rear panel, where the rear panel is folded such that the first fastener can engage the second fastener when the pocket assembly is placed in the loop configuration.

9. A system as recited in claim 6, in which the first substrate is an article of clothing.

10. A system as recited in claim 9, in which, when the article of clothing is worn, the third fastener is adjacent to the wearer's shoulder, the fourth fastener is adjacent to the wearer's chest, and the fifth fastener is adjacent to the wearer's back.

11. A system as recited in claim 6, in which:

the first, fourth, and fifth fasteners are of a first type; and the second and third fasteners are of a second type, where the first and second types of fasteners are complementary such that fasteners of the first type engage fasteners of the second type to form a detachable attachment system.

12. A system as recited in claim 11, in which:

the first type of fastener is one of a female snap fastener and a male snap fastener; and the second type of fastener is another of a female snap fastener and a male snap fastener.

13. A system as recited in claim 11, in which:

the first type of fastener is one of a button and a button hole; and the second type of fastener is another of a button and a button hole.

14. A system as recited in claim 11, in which:

the first type of fastener is one of a hook fabric and a loop fabric; and the second type of fastener is another of a hook fabric and a loop fabric.

15. A system as recited in claim 11, in which:

the first type of fastener is one of a female fastener and a male fastener; and the second type of fastener is another of a female fastener and a male fastener.

16. A method of holding an electronic device comprising the steps of:

supporting a first substrate on a wearer;

providing a pocket assembly adapted to hold the electronic device;

rigidly connecting first and second fasteners to the pocket assembly;

rigidly connecting third, fourth, and fifth fasteners to the substrate;

attaching the pocket assembly to the first substrate in a first position by engaging the first fastener with the third fastener and the second fastener with the fourth fastener; and attaching the pocket assembly to the first substrate in a second position by engaging the first fastener with the third fastener and the second fastener with the fifth fastener;

spacing the third, fourth, and fifth fasteners from each other such that the electronic device is supported substantially in front of the wearer when the pocket assembly is in the first position; and the electronic device is supported substantially behind of the wearer when the pocket assembly is in the second position.

17. A method as recited in claim 16, further comprising the steps of:

providing a second substrate; and placing the pocket assembly in a loop configuration in which the pocket assembly extends around at least a portion of the second substrate; and securing the pocket assembly to the second substrate by engaging the first fastener with the second fastener.

18. A method as recited in claim 17, in which:

the step of providing the pocket assembly comprises the step of providing a flexible rear panel; and the step of securing the pocket assembly to the second substrate in the third mode comprises the steps of folding the rear panel to place the pocket assembly in the loop configuration, and engaging the first fastener with the second fastener.

19. A method as recited in claim 16, further comprising the step of arranging the substrate such that the third fastener is adjacent to the wearer's shoulder, the fourth fastener is adjacent to the wearer's chest, and the fifth fastener is adjacent to the wearer's back.

20. A method of holding an electronic device comprising the steps of:

supporting a first substrate on a wearer;

providing a pocket assembly adapted to hold the electronic device;

rigidly connecting first and second fasteners to the pocket assembly;

rigidly connecting third, fourth, and fifth fasteners to the substrate;

attaching the pocket assembly to the first substrate in a first position by engaging the first fastener with the third fastener and the second fastener with the fourth fastener;

attaching the pocket assembly to the first substrate in a second position by engaging the first fastener with the third fastener and the second fastener with the fifth fastener; and arranging the substrate such that the third fastener is adjacent to the wearer's shoulder, the fourth fastener is adjacent to the wearer's chest, and the fifth fastener is adjacent to the wearer's back.

* * * * *